US006782943B2

(12) United States Patent
Baudelet

(10) Patent No.: US 6,782,943 B2
(45) Date of Patent: Aug. 31, 2004

(54) FOULING REDUCTION DEVICE FOR A TUBULAR HEAT EXCHANGER

(75) Inventor: Claude Baudelet, Saint Germain En Laye (FR)

(73) Assignee: Elf Antar France, Puteaux (FR)

( * ) Notice: Subject to any disclaimer, the term of this patent is extended or adjusted under 35 U.S.C. 154(b) by 0 days.

(21) Appl. No.: 10/058,102

(22) Filed: Jan. 29, 2002

(65) Prior Publication Data

US 2002/0100580 A1 Aug. 1, 2002

(30) Foreign Application Priority Data

Jan. 30, 2001 (FR) ..... 01 01218

(51) Int. Cl.[7] ..... F28F 9/02

(52) U.S. Cl. ..... 165/174; 148/427; 420/452; 420/453; 420/459

(58) Field of Search ..... 165/174; 148/427; 420/452, 453, 459

(56) References Cited

U.S. PATENT DOCUMENTS

| | | | | | |
|---|---|---|---|---|---|
| 2,318,206 | A | | 5/1943 | Gustav | |
| 2,340,181 | A | * | 1/1944 | Geddes | 138/38 |
| 3,648,754 | A | * | 3/1972 | Stephen | 159/13.2 |
| 4,102,393 | A | * | 7/1978 | Withers, Jr. | 165/95 |
| 4,641,705 | A | * | 2/1987 | Gorman | 165/85 |
| 4,727,907 | A | * | 3/1988 | Duncan | 138/38 |
| 5,217,684 | A | | 6/1993 | Igarashi et al. | |
| 2001/0003307 | A1 | * | 6/2001 | Sivacoe | 165/95 |

FOREIGN PATENT DOCUMENTS

| | | |
|---|---|---|
| EP | 0 066 361 | 12/1982 |
| EP | 0 226 458 | 6/1987 |
| FR | 2 479 964 | 10/1981 |
| GB | 481 105 | 2/1938 |
| GB | 1 210 607 | 10/1970 |

OTHER PUBLICATIONS

ASM Handbook, (Formerly Tenth Edition, Matels Handbook) vol. 2, pp. 436 and 438, 1992.*

* cited by examiner

*Primary Examiner*—John P Sheehan
(74) *Attorney, Agent, or Firm*—Sughrue Mion, PLLC

(57) ABSTRACT

A fouling reducing device for the tubes of a tubular heat exchanger of the type that contains at least one turbulence-generating element lodged inside one of the tubes of the exchanger. The fouling reducing device is a turbulence-generating element made of a metallic alloy with a nickel content that is greater than 50% by weight, and further made of at least one metal chosen from among chrome and molybdenum. The turbulence-generating element has an improved resistance to corrosion when in contact with a hydrocarbon, such as crude oil.

6 Claims, No Drawings

FOULING REDUCTION DEVICE FOR A TUBULAR HEAT EXCHANGER

TECHNICAL FIELD

The invention relates to fouling reduction devices for tubular heat exchangers.

It is applied in the oil and petrochemistry industries that operate tubular heat exchangers wherein circulate corrosive liquids.

DESCRIPTION OF THE RELATED ART

Tubular heat exchangers equipped with fouling reduction devices are described in patent EP 0 174 254 dated Nov. 9, 1986.

According to this document, fouling reducers mounted inside the exchanger tubes comprise a mobile turbulence generating element that consists of a metallic winding in the form of an unstretchable solenoid, held in position by a hanging system in such a manner that the turbulence generating element can be driven in rotation by the liquid that circulates in the exchanger.

In order for the mobile components to be unstretchable, they are usually made of steel of the piano-wire type, also called spring steel.

When these turbulence generating elements are put in contact with corrosive liquids, as is the case for example in the tubular exchangers used to warm up crude oil in atmospheric distillation units in oil refineries, they are subjected to various types of corrosion that lead to their destruction.

In these exchangers, the crude oil that circulates in the tubes has a low water load and contains mineral salts of which chlorides, sulfide compounds, such as hydrogen sulfide or thiols and naphthenic acids, that give it the properties of a particularly corrosive matter.

Below 150° C., an attack on the spring steel by the hydrogen ions leads to a fast inter-granular embrittlement that causes the turbulence generating elements to rupture.

Above 220° C., after the crude oil has gone through the desalting process, the percentage of chlorides still present ranges between 0.1 and 0.2%. The presence of hydrochloric acid from the hydrolysis of the chlorides still present leads to a slow corrosion of the mobile elements.

At 250° C. and up, the naphthenic acids also lead to a slow corrosion of the turbulence generating elements.

The hydrogen sulfide, resulting from combining the hydrogen with the organic sulfur contained in the hydrocarbon load, furthers the rupture by embrittlement of the turbulence generating elements. The presence of thiols in the hydrocarbon load accelerates the corrosion.

Other fouling reducers for tubular heat exchangers are described in patent FR 2 479 964 dated Apr. 8, 1980.

According to this document, the fouling reducers mounted inside the exchanger tubes each comprise a turbulence generating element that consists of a metallic winding in the form of an elastic solenoid, that extends over the entire length of the tubes and is agitated by the liquid that circulates in the exchanger.

These mobile elastic elements are usually obtained by stretching a spring made of piano-wire.

Like the mobile elements described in document EP 0 174 254, they are embrittled by the corrosion, but, as they are stretched, they run the additional risk of stress corrosion, namely when they are in the presence of chlorides, even at low levels of approximately 30 mg per liter in the liquid that circulates inside the exchangers' tubes.

One known solution for lowering the risk of corrosion consists in making the mobile elements and their hanging systems from cold worked titanium.

However, this metal has the disadvantage of not having enough tensile strength to provide the mobile elements with the stiffness necessary for them to function properly.

Other known fouling reducers for a tubular heat exchanger, comprising at least one turbulence generating element, fixed, set inside one of the tubes have the same disadvantages.

BRIEF SUMMARY OF THE INVENTION

The object of this invention is to remedy the disadvantages of the prior art by providing fouling reducing devices for tubular heat exchangers, wherein the fouling reducing devices resist corrosion.

Accordingly, there is provided a fouling reducing device for tubular heat exchangers of the type that comprise at least one turbulence-generating element set inside one of the tubes of said exchanger. The fouling reducing device comprises a turbulence-generating element. When in use, the turbulence-generating element is brought in contact with an environment that contains hydrocarbons, namely crude oil. The turbulence-generating element is characterized in that it is made of a metallic alloy with a nickel content that is greater than 50% by weight, and that, in addition, it comprises at least one metal chosen from the group consisting of chrome and molybdenum, in order to improve its resistance to corrosion.

According to another characteristic of the turbulence-generating element of the present invention, in order for it to be resistant to corrosion when stretched, the metallic alloy of which it is made has a chrome (TCr) and molybdenum (TMo) content expressed in % by weight of the alloy, so that the following relation can be verified:

$TCr+3.3\times TMo>36\%$ by weight of the metallic alloy.

According to another characteristic of the turbulence-generating element of the present invention, the metallic alloy of which it is made comprises the following metals, in the indicated content ranges:

nickel: between 55 and 65% by weight, chrome: between 20 and 25% by weight, molybdenum: between 5 and 10% by weight, niobium: between 2.5 and 4% by weight, and iron: to complete at 100%.

DETAILED DESCRIPTION OF THE INVENTION

In general, the fouling reducing device of the present invention is used to reduce the fouling of tubular heat exchangers wherein circulate corrosive liquids.

This is namely the case for heat exchangers used to warm up crude oil in the atmospheric distillation units of crude oil upgrading plants.

This crude oil contains a small quantity of water, mineral salts and sulfur compounds which makes it particularly corrosive.

According to a preferred method for implementing the invention, the fouling reducers for these exchangers are made of a metallic alloy that consists of the following materials (in % by weight):

Nickel: 64.9

Chrome: 22.16

Molybdenum: 8.75

Niobium: 3.62

Iron: 0.19

Titanium: 0.18

Aluminum: 0.089

Silicon: 0.057

Magnesium: 0.022

Carbon: 0.012

Copper: 0.010

Cobalt: 0.005

Phosphorus: 0.003

Sulfur: 0.002

With this alloy, the expression TCr+3.3 TMo, where TCr represents the chrome content and TMo represents the molybdenum content, equals 22.16+3.3×8.75, or 51.03% by weight.

Thus, the TCr+3.3 TMo=36% by weight relation is verified.

Thanks to this alloy, the fouling reducing device resists stress corrosion and corrosion of the inter-granular type.

Furthermore, this alloy has a tensile strength of 1650 MPa, much greater than that of titanium, which is in the 700 MPa range, and is largely sufficient for the fouling reducing devices to operate correctly.

This invention is not limited to exchangers wherein circulates crude oil. It can also be applied to petrochemical unit exchangers wherein circulate other corrosive hydrocarbons.

EXAMPLE

This example relates to fouling reducing devices for heat exchangers used to warm up crude oil of the light Arabic type, in an atmospheric distillation unit of a crude oil upgrading plant that is not equipped with a desalting device.

Each exchanger comprises a shell, inside which are mounted 564 tubes whose inner diameter is equal to 20.2 mm and whose length is of approximately 6100 mm. On the shell side an atmospheric distillation residue circulates. Said residue emanates from the bottom of the atmospheric distillation column that warms up the non desalted crude oil that circulates inside said tubes to a temperature of 260° C. Fouling reducing devices of the type described in patent FR 2 479 964 are mounted inside these tubes.

These fouling reducing devices are in the shape of solenoids made from a metallic alloy wire with a diameter of 1.2 mm that contains 64.9% of nickel and 8.75% of molybdenum, as defined above.

When the crude oil circulates in the tubes, the fouling reducers are stretched and then have an outer diameter of approximately 15 mm.

The crude oil that circulates in the exchanger tubes has an average water content of 0.8%, expressed in volume, an average sodium chloride content of 30 mg per liter and an average sulfur product content of 1.8% by weight, expressed in total sulfur.

Under these conditions, the life expectancy of the fouling reducing devices made in accordance with the invention is of approximately 2 years, whereas it is of only 12 months for the fouling reducers made of spring steel.

The fouling reducing devices for heat exchangers as set forth in the Example, installed in the exchangers of a steam cracking petrochemical unit also show a significant increase in their life expectancy.

What is claimed is:

1. Fouling reducing device for use inside tubes of a tubular heat exchanger, comprising a turbulence-generating element, wherein said turbulence-generating element is brought, during its use, in contact with an environment that contains crude oil, said turbulence-generating element, comprises a metallic alloy whose nickel content is greater than 50% by weight and includes at least one metal selected from the group consisting of chrome and molybdenum to improve its resistance to corrosion, and said turbulence-generating element is in the form of a solenoid.

2. Device as set forth in claim 1, wherein the metallic alloy has a chrome content, TCr, and a molybdenum content, TMo, expressed in % weight of the alloy, so that the following relation is met:

TCr+3.3×TMo>36% by weight of the metallic alloy.

3. Device as set forth in claim 1, wherein the metallic alloy comprises the following metals, in the following content ranges in % by weight:

between 55 and 65% of nickel;

between 20 and 25% of chrome;

between 5 and 10% of molybdenum;

between 2.5 and 4% of niobium; and the remainder of iron.

4. A method of reducing fouling in a crude oil refinery exchanger, comprising lodging at least one device as set forth in claim 1 inside a tube of said exchanger.

5. Device as set forth in claim 1, wherein said solenoid is an unstretchable solenoid.

6. Device as set forth in claim 1, wherein said solenoid is an elastic solenoid.

* * * * *